United States Patent [19]

Felser

[11] Patent Number: 4,640,069

[45] Date of Patent: Feb. 3, 1987

[54] METHOD AND APPARATUS FOR CONSTRUCTION OF BUILDINGS TO GIVE THE APPEARANCE OF FULL LOG CONSTRUCTION

[75] Inventor: Theodore P. Felser, Winter, Wis.

[73] Assignee: Felser Forest Products, Inc, Winter, Wis.

[21] Appl. No.: 851,587

[22] Filed: Apr. 14, 1986

[51] Int. Cl.[4] ..... E04B 1/10

[52] U.S. Cl. ..... 52/233; 52/747

[58] Field of Search ..... 52/233, 313, 747

[56] References Cited

U.S. PATENT DOCUMENTS

| | | | |
|---|---|---|---|
| 1,654,120 | 12/1927 | Ewing | 52/233 |
| 2,309,426 | 1/1943 | Williams | 52/233 |
| 3,849,960 | 11/1974 | Henry et al. | 52/233 X |
| 4,056,906 | 11/1977 | Elfström | 52/233 |
| 4,277,925 | 7/1981 | Kinser | 52/233 |
| 4,320,610 | 3/1982 | Rupp | 52/233 |
| 4,592,182 | 6/1986 | Felser | 52/233 |

*Primary Examiner*—William F. Pate, III
*Assistant Examiner*—Jean M. LaKemper
*Attorney, Agent, or Firm*—Nicholas A. Kees; James E. Nilles

[57] ABSTRACT

Apparatus and method for construction of buildings to give the appearance of full log construction. Conventional wall studs are assembled in basically a conventional manner except that the corner is assembled in an "open" manner rather than the usual "closed" assembly, so that the corner studs form a V which opens toward the outside of the building. A corner block assembly, having been pre-assembled, is then inserted into this open corner. The corner block assembly extends vertically coextensively with the height of the corner of the building. It is constructed of vertical studs and log blocks attached horizontally to these studs. The log blocks are arranged so as to alternately protrude, first from one side and then from the other, each log block being perpendicular to the block above it and the one below it and to the stud to which it attached. One side of each log block is aligned with the outer edge of the stud to which it is attached. The side of each log block opposite the side aligned with the studs is curved in a cylindrically convex shape, except for a portion where the cylindrically convex surface is cut off so that the log block fits flat against the respective parallel stud. Siding is then applied to the building, and alternating portions of siding extend beyond the corners coextensive with the log blocks. The outer side of the siding is also cylindrically convex, so that the log blocks and matched siding give the appearance of full log construction, with all the advantages (insulation, weatherproofing, etc.) of conventional frame construction. In one embodiment the siding intersecting each log block is cut off concave so as to match the cylindrically convex outer surface of the log block. In another embodiment the portion of the log block where the cylindrically convex shape is cut off is extended beyond the respective parallel stud so as to accommodate the intersecting siding fitting against the flattened area. The intersecting siding is cut off flat so as to fit against the extended flattened area, again providing a good weatherseal.

7 Claims, 6 Drawing Figures

METHOD AND APPARATUS FOR CONSTRUCTION OF BUILDINGS TO GIVE THE APPEARANCE OF FULL LOG CONSTRUCTION

BACKGROUND OF THE INVENTION

This invention relates to apparatus and a method for using that apparatus to construct a building having a "log cabin" appearance, and in particular to method and apparatus wherein log blocks are assembled to siding having a convex outer surface to give the appearance of full logs protruding alternately at the corner of a building.

Previously, most "log home" type buildings were built in one of two ways. In one method whole round logs were stacked, one on top of another, to form the walls of the building, with the ends of the logs protruding alternately, in standard pioneer fashion. In the other commonly used method, siding with a rounded outside face was applied to a standard wood frame house to give a log appearance, although at the corners the siding was simply mitered at 45 degrees, giving the building square corners.

The disadvantage of the first method is that a great deal of sealing material must be placed between the logs in order to seal out the weather. Even if this is done, however, insulation is still a problem, as wood is a poor insulator against the cold, compared to modern commercial insulation, such as fiberglass. The disadvantage of the second method is that, with the squaring of the corners, the classic alternating protruding log appearance is lost completely. The building then looks much like any other frame building having wood siding.

The structure described in Williams, U.S. Pat. No. 2,309,426, attempts to solve certain of these problems. That patent describes a structure wherein the rounded siding is attached to the studs by means of angle irons. The ends of the siding boards are alternately extended beyond the corners. The disadvantage here again is that the appearance is merely that of a board protruding beyond the corner, not an actual log in the classic pioneer style.

Another structure is described in Ewing, U.S. Pat. No. 1,654,120. This structure does provide for log-shaped protrusions extending beyond the corner of the subject building. The structure disclosed in Ewing, however, may be subject to substantial weather damage during years of use. Further, it has a large number of parts, and so it would be advantageous to reduce the part count in order to make assembly and construction easier and faster.

Finally, yet another structure is disclosed in U.S. Pat. No. 4,592,182, issued June 3, 1986, invented by the same inventor as the present invention and assigned to the same assignee. That patent shows log blocks attached to the studs which are part of the walls of the building. Each log block has one cylindrically convex side, with siding attached to the opposite side. Further, the siding perpendicular to the log block is coped to fit around the convex surface of the log block side. This apparatus still involves substantial onsite assembly, whereas the trend today appears to be toward pre-assembling several parts into modules and then assembling the modules onsite. Further, a need exists for a modular assembly that can be assembled without the need for large cranes onsite and by people having only ordinary construction expertise.

This invention relates to improvements over the apparatus referred to above and to solutions to the problems raised thereby.

SUMMARY OF THE INVENTION

The log cornering apparatus of the present invention includes conventional wall studs which are assembled in basically a conventional manner except that the corner is assembled in an "open" manner rather than the usual "closed" assembly, so that the corner studs meet at the inside of the corner, rather than the outside, forming a V opening outwardly. A corner block assembly is then inserted into this open corner. The corner block assembly runs coextensively with the height of the corner. It is pre-assembled with studs and log blocks attached horizontally thereto and arranged so as to alternately protrude, first from one side and then from the other. One side of each log block is curved in a cylindrically convex shape. Siding is then applied to the building, and alternating portions of siding extend beyond the corners to match the log blocks. The outer side of the siding is also cylindrically convex, and it is applied to a flat side of the log block opposite the convex side so that the log blocks and matched siding give the appearance of full log construction, with all the advantages of conventional frame construction.

It is thus an object of the invention to provide a building with a corner which is modularly assembled and which gives the appearance of full log construction, while maintaining the benefits of conventional frame construction.

Another object of the invention is to provide such a building which is easily and quickly assembled and which provides the alternating protruding log end appearance of a full log building, with all the advantages of conventional frame construction.

A more specific object of the invention is to provide a building as described above wherein a corner block assembly having log blocks alternately protruding therefrom is pre-assembled and installed at the corner, with cylindrically convex siding installed thereover to give a full log appearance.

Other objects and advantages of this invention will become apparent hereinafter.

DESCRIPTION OF THE PREFERRED EMBODIMENTS

Figure 1:
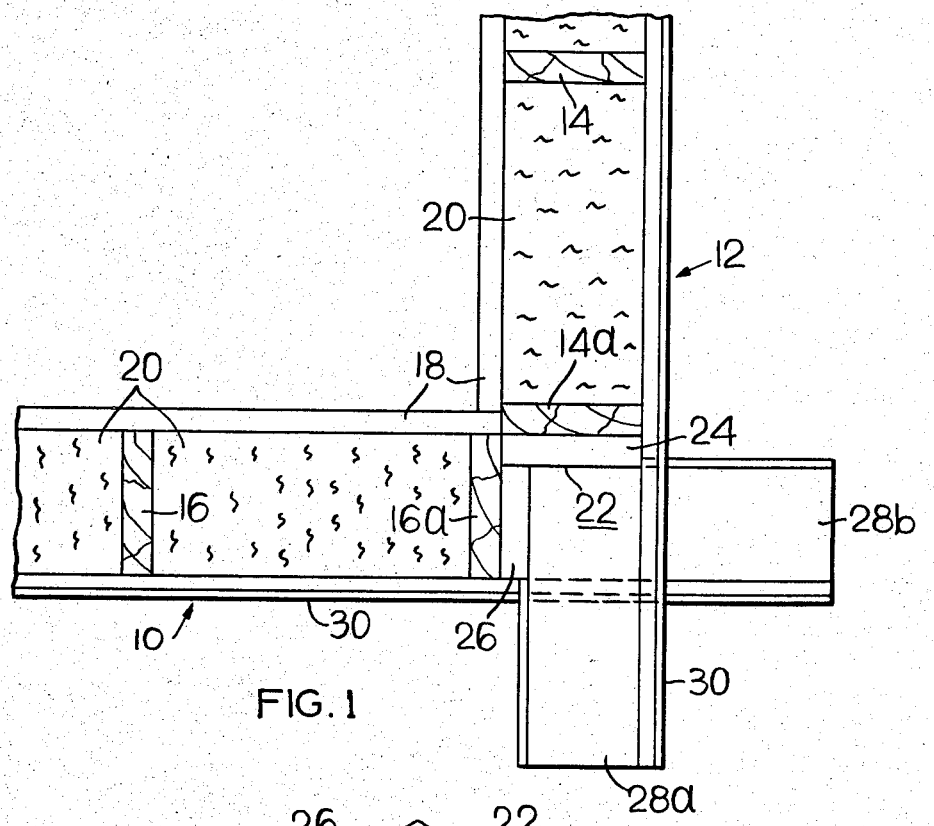
FIG. 1 is a top view of an apparatus for constructing a building according to one embodiment of the invention.

Referring now to the drawing figures, the invention includes two intersecting vertical walls 10 and 12 of a building which are constructed perpendicular to each other, basically according to conventional methods.

Each wall 10 and 12 includes conventional vertical studs 14 and 16 in the interior thereof for structural support and conventional interior wall finishing materials 18 such as paneling or drywall attached on the inside of the studs 14 and 16. It is also desirable and customary to add insulation 20 within the walls 10 and 12.

Figure 2:
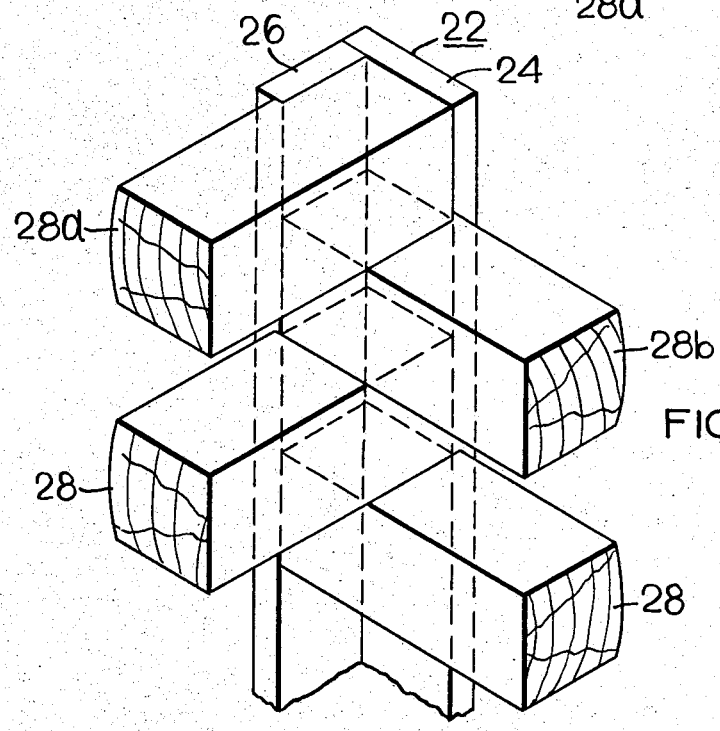
FIG. 2 is an isometric view of a portion of a corner block assembly employed in the embodiment shown in FIG. 1.
Figure 4:
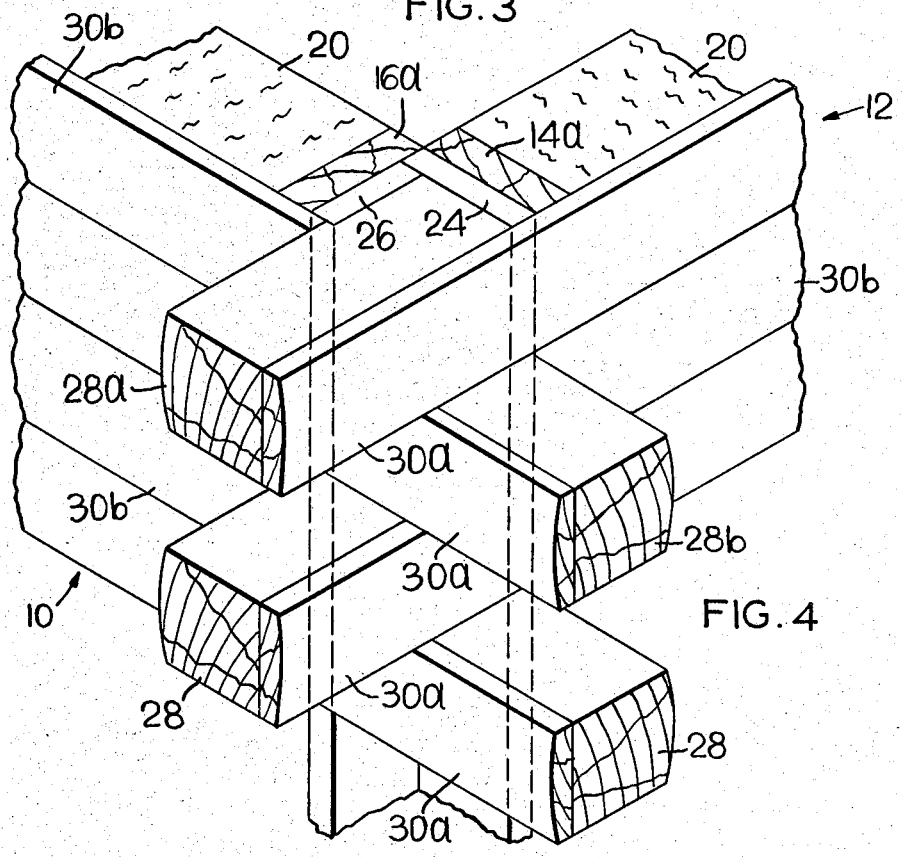
FIG. 4 is an isometric view of the embodiment shown in FIG. 1.

Each of the intersecting wall sections 10 and 12 has a vertical end stud 14*a* and 16*a*, respectively, at its end. Wall sections 10 and 12 are assembled together so that end studs 14*a* and 16*a* contact each other at the inside corner, forming a V which opens toward the outside of the building as shown best in FIGS. 1 and 4, rather than contacting each other at the outside as is conventional. A corner block assembly 22, having been preassembled as shown in isometric in FIG. 2, is then installed vertically into the opening of the V formed by the studs 14*a* and 16*a*, and is coextensive with the height of the vertical wall sections 10 and 12. This corner block assembly 22 includes vertical studs 24 and 26 attached to each other at right angles. One stud 26 is narrower than the other stud 24 so as to properly fit with the end studs 14*a* and 16*a*. A plurality of log blocks 28 are each attached horizontally at one end thereof to the studs 24 and 26 by any suitable permanent means. These log blocks 28 are attached to the studs in an alternating manner, perpendicular to each other and partially overlying each other, along the vertical length of the studs 24 and 26. That is, for instance, the proximal end of topmost log block 28*a* is attached to right stud 24, arranged perpendicular thereto. Correspondingly, the next lower log block 28*b* is attached to the left stud 26, arranged perpendicular to stud 26 and also perpendicular to topmost log block 28*a*. The rest of the log blocks 28 are attached to the studs 24 and 26 similarly, in an alternating manner, for the length of the studs.

Figure 3:
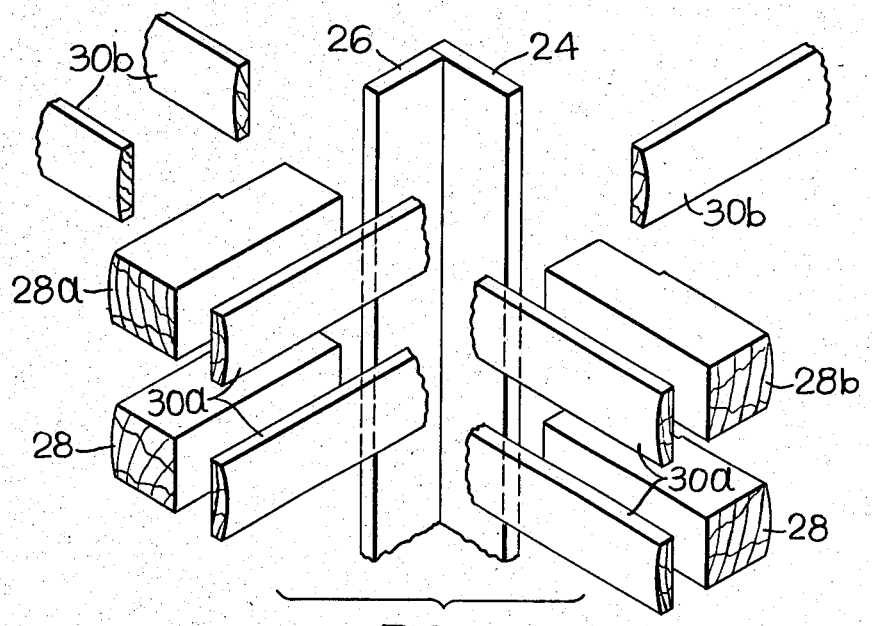
FIG. 3 is an exploded isometric view of the embodiment shown in FIG 1.

As referred to above, this corner block assembly 22 is then attached to the corner studs 14*a* and 16*a*. Once so attached, the right stud 24 fits flat and flush against the first wall stud 14*a*, and the left stud 26 fits flat and flush against the second wall stud 16*a*. Next the outer wall coverings are applied. The inner layers thereof, such as sheathing and so on, are conventional and will not be described here. The outermost layer of the outer wall covering is a layer of siding 30 horizontally applied to the wall studs 14 and 16. The vertical dimension of the siding 30 is the same as that of the log blocks 28. The outer surface of this siding 30 is cylindrically convex along its longitudinal axis. As shown in FIG. 2, log blocks 28 are mounted to corner block assembly studs 24 and 26 so that one side of the block 28 is flush with the outer edge of the stud. The side of each log block opposite the flush side has a cylindrically convex shape over most of its length, which matches the cylindrically convex shape of the outer surface of the siding 30. A short portion of this opposite side near the end of the block which is butted against corner block assembly stud 24 or 26 has had the cylindrically convex surface removed, leaving a flat surface just long enough to fit flat against the parallel corner block assembly stud 26 or 24 respectively. This avoids any gap which would otherwise occur between the log block 28 and the studs 24 and 26. As shown most clearly in FIGS. 3 and 4, then, when the siding 30 is applied to the outside of the walls 10 and 12, it is also applied to the flush side of the log blocks 28 coextensively, so that the ends of the particular pieces of siding 30*a* coincide with the end of the particular log blocks 28 to which they are applied. Thus each log block 28 having siding 30 applied to it gives the appearance of a full log projecting beyond the corner of the subject building. Since log blocks 28 alternate, one projecting one way and the next projecting perpendicular thereto, the appearance of the classic log cabin is presented, even though the insulation, weatherproofing and other advantages of conventional modern construction methods and materials are maintained.

The siding 30 on the wall intersecting the particular log block 28 must be cut so as to properly butt against the cylindrically convex side of the log block 28 and thus seal out the weather properly. Thus, in one embodiment, shown best in FIG. 3, the end of the siding piece 30*b* which butts against the log block 28 is coped in a concave shape so as to match the cylindrically convex outer surface of the log block 28.

Figure 5:
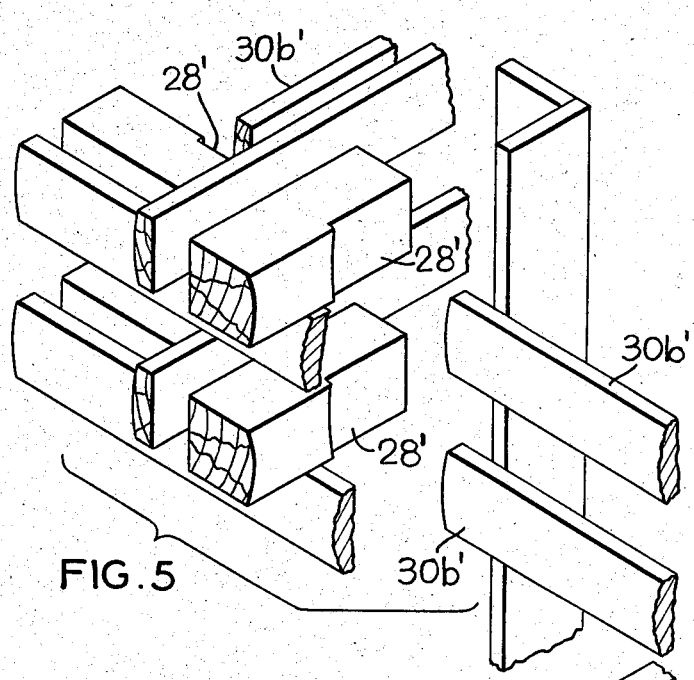
FIG. 5 is an exploded isometric view of an apparatus for constructing a building according to another embodiment of the invention.
Figure 6:
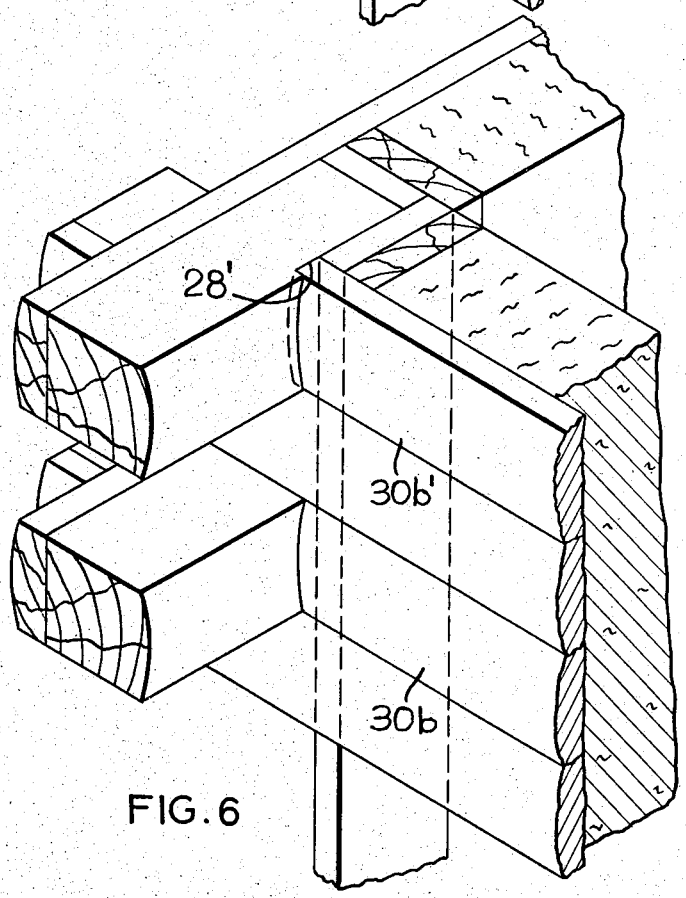
FIG. 6 is an isometric view of the embodiment shown in FIG. 5.

Alternatively, in the embodiment shown in FIGS. 5 and 6, the cylindrically convex face of the log block 28 has an area 28' where the cylindrically convex outer surface of the log block which has been cut off flat is extended outward beyond that necessary to fit with studs 24 and 26. This extension 28' of the flattened area of log block 28 is just large enough to accommodate the end of a siding piece 30*b'*. Siding piece 30*b'* has been correspondingly been cut off flat rather than concave, so as to properly fit in the groove 28'. Hence a corner is provided which is gives the appearance of a log cabin and which is very weathertight and energy efficient though easy to assemble even for someone not extremely skilled or experienced in construction.

While the apparatus hereinbefore described is effectively adapted to fulfill the aforesaid objects, it is to be understood that the invention is not intended to be limited to the particular preferred embodiments of method and apparatus for construction of buildings to give the appearance of full log construction herein set forth. Rather, it is to be taken as including all reasonable equivalents without departing from the scope of the appended claims.

I claim:

1. Apparatus for construction of buildings to give the appearance of full log construction, comprising:

a first wall section comprising studs including at least one end stud located near one end thereof, and having wall finishing materials attached to the inside of said studs;

a second wall section also comprising studs including at least one end stud located near one end thereof, and having wall finishing materials attached to the inside of said studs, said first and second walls being assembled together at approximately right angles to each other such that said end stud of said first wall contacts said end stud of said second wall at approximately right angles to form a V which opens toward the outside of the building;

a corner block assembly, having two studs assembled perpendicular to each other and arranged vertically so as to fit against said end studs of said first and second wall sections, and having log blocks arranged horizontally and attached at one end thereof alternately perpendicular to first one and then the other of said two studs;

siding, having a cylindrically convex outer surface, horizontally applied to the outside of said studs, having a vertical dimension approximately the same as that of said log blocks, and applied coextensively with said log blocks.

2. An apparatus as recited in claim 1 wherein said log blocks each have one side aligned with the outside edge of the stud of said corner block assembly perpendicular to said log block, the opposite side of each said block having a cylindrically convex shape.

3. An apparatus as recited in claim 2 wherein said log blocks extend beyond the corner of the building and wherein the end of the siding which intersects each log block at the corner is coped in a concave shape so as to fit around the cylindrically convex shape of said log block.

4. An apparatus as recited in claim 2 wherein said log blocks extend beyond the corner of the building and wherein each log block has a portion of its cylindrically convex face cut off flat, the end of the siding which intersects each log block at the corner being cut off flat so as to fit against said flat portion of said log block.

5. A method for constructing buildings to give the appearance of full log construction, comprising:

assembling a corner block assembly, including assembling two studs perpendicular to each other and attaching a plurality of log blocks alternately perpendicular first to one and then to the other of said two studs so that said log blocks each have one side aligned with the outside edge of the stud perpendicular thereto;

assembling a first wall section of studs including locating at least one end stud near one end thereof, and applying wall finishing materials to the inside of said studs;

assembling a second wall section also of studs including locating at least one end stud near one end thereof, and applying wall finishing materials to the inside of said studs, said first and second walls being assembled together at approximately right angles to each other such that said end stud of said first wall contacts said end stud of said second wall at approximately right angles to form a V which opens toward the outside of the building;

attaching said corner block assembly vertically to said end studs of said walls such that the log blocks extend beyond the corner of the building;

applying siding horizontally to the outside of said studs, said siding having a vertical dimension approximately the same as that of said log blocks, said siding being applied coextensively with said log blocks.

6. A method as recited in claim 5 wherein the siding on the side of the building perpendicular to each log block is coped in a concave shape so as to fit around the cylindrically convex shape of each said log block.

7. A method as recited in claim 5 wherein each log block has a portion of its cylindrically convex face cut off flat, the end of the siding which intersects each log block at the corner being cut off flat so as to fit against said flat portion of said log block.

* * * * *